US006942170B2

(12) United States Patent
Casalmir et al.

(10) Patent No.: US 6,942,170 B2
(45) Date of Patent: Sep. 13, 2005

(54) PLURAL ODD NUMBER BELL-LIKE OPENINGS NOZZLE DEVICE FOR A FLUIDIZED BED JET MILL

(75) Inventors: D. Paul Casalmir, Sodus, NY (US); Samir Kumar, Penfield, NY (US); Fumii Higuchi, Mississauga (CA)

(73) Assignee: Xerox Corporation, Stamford, CT (US)

( * ) Notice: Subject to any disclaimer, the term of this patent is extended or adjusted under 35 U.S.C. 154(b) by 179 days.

(21) Appl. No.: 10/368,336

(22) Filed: Feb. 18, 2003

(65) Prior Publication Data

US 2004/0016834 A1 Jan. 29, 2004

Related U.S. Application Data

(60) Provisional application No. 60/398,072, filed on Jul. 23, 2002.

(51) Int. Cl.[7] ..... B02B 1/00; B02B 5/02; B02C 11/08; B02C 21/00; B02C 23/18

(52) U.S. Cl. ..... 241/39; 241/38; 241/40; 241/41

(58) Field of Search ..... 241/39, 40, 38, 241/41

(56) References Cited

U.S. PATENT DOCUMENTS

| | | | | |
|---|---|---|---|---|
| 2,605,144 A | * | 7/1952 | Northup | 239/544 |
| 3,565,348 A | | 2/1971 | Dickerson et al. | 241/5 |
| 4,059,231 A | | 11/1977 | Neu | 241/5 |
| 4,089,472 A | | 5/1978 | Siegel et al. | 241/5 |
| 5,423,490 A | | 6/1995 | Zampini | 241/5 |
| 5,628,464 A | * | 5/1997 | Smith et al. | 241/5 |
| 6,102,756 A | * | 8/2000 | Michel et al. | 440/42 |
| 6,196,479 B1 | * | 3/2001 | Edlinger | 241/1 |

* cited by examiner

*Primary Examiner*—Derris H. Banks
*Assistant Examiner*—Jason Y Pahng
(74) *Attorney, Agent, or Firm*—Tallam I. Nguti

(57) ABSTRACT

A jet mill includes plural nozzle devices for discharging a composite stream of high velocity fluid. Each nozzle device includes a plural odd number of nozzle openings for discharging an individual stream of high velocity fluid. Each nozzle opening comprises (i) a converging region for converging and accelerating a volume of high pressure fluid; (ii) a throat region defining a narrowest diameter region of the nozzle opening; (iii) a first expansion region for producing a linear expansion of the volume of high pressure fluid, and (iv) a second expansion region for producing a turning expansion as well as a parallel flow of the volume of high pressure fluid. The first expansion region has a radius "r1" and a length "s1" with radius r1 and length s1 determined such that (dr1/ds1) is a constant. The second expansion region has a radius "r2" and a length "s2" with radius r2 and length s2 determined such that (dr2/ds2) is non-linear and a function of s2.

20 Claims, 9 Drawing Sheets

PLURAL ODD NUMBER BELL-LIKE OPENINGS NOZZLE DEVICE FOR A FLUIDIZED BED JET MILL

CROSS REFERENCE TO ISSUED PATENTS

This application is based on a Provisional Patent Application No. 60/398,072, filed Jul. 23, 2002.

Attention is directed to commonly owned and assigned U.S. Pat. No. 5,133,504 issued Jul. 28, 1992, entitled THROUGHPUT EFFICIENCY ENHANCEMENT OF FLUIDIZED BED JET MILL, and U.S. Pat. No. 5,683,039 issued Nov. 4, 1997, entitled LAVAL NOZZLE WITH CENTRAL FEED TUBE AND PARTICLE COOMINUTION PROCESS THEREOF.

The disclosures of the above mentioned patents are incorporated herein by reference in their entireties.

RELATED APPLICATIONS

This application is related to U.S. application Ser. No. 10/368,338 entitled "PARTICLE ENTRAINING EDUCTOR-SPIKE NOZZLE DEVICE FOR A FLUIDIZED BED JET MILL" filed on the same date herewith, and having at least one common inventor.

BACKGROUND OF THE INVENTION

Jet mills are size reduction machines in which particles to be ground (feed particles) are entrained and accelerated in a stream or jet of fluid such as compressed air or steam, and then ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming fluid before introduction into the grinding chamber. In the Majac mill, two streams of mixed particles and fluid are directed against each other within the grinding chamber to cause fracture of the particles. An alternative to the Majac mill configuration is to accelerate within the grinding chamber particles that are introduced from another source. An example of the latter is disclosed in U.S. Pat. No. 3,565,348 to Dickerson, et al., which shows a mill with an annular grinding chamber into which numerous fluid jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the fluid and particle mixture in the grinding chamber. For example, in "pancake" mills, the fluid is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber.

Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the rotor, the smaller the particles. These particles become the mill product. Oversized particles are returned to the grinding chamber, typically by gravity.

Yet another type of fluid energy mill is the fluidized bed jet mill in which a plurality of fluid jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the fluid jet flows; the particles impinge against each other and are fragmented within this region. A mechanical classifier is mounted at the top of the grinding chamber between the top of the fluidized bed and the entrance to the collector outlet.

The primary operating cost of jet mills is from the power used to drive the compressors that supply the pressurized fluid. The efficiency with which a mill grinds a specified material to a certain size can be expressed in terms of the throughput of the mill in mass of finished material for a fixed amount of power produced by the expanding fluid. One mechanism proposed for enhancing grinding efficiency is the projection of particles against a plurality of fixed, planar surfaces, fracturing the particles upon impact with the surfaces. An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream or jet passing through the duct are fractured as they strike the impact bars. U.S. Pat. No. 4,089,472 to Siegel, et al. discloses an impact target formed of a plurality of planar impact plates of graduated sizes connected in spaced relation with central apertures through which a particle stream or jet can flow to reach successive plates. The impact target is interposed between two opposing fluid particle streams, such as in the grinding chamber of a Majac mill.

Although fluidized jet mills can be used to grind a variety of particles, they are particularly suited for grinding other materials, such as toners, used in electrostatographic reproducing processes. These toner materials can be used to form either two component developers, typically with a coarser powder of coated magnetic carrier material to provide charging and transport for the toner, or single component developers, in which the toner itself has sufficient magnetic and charging properties that carrier particles are not required.

The toners are typically melt compounded into sheets or pellets and processed in a hammer mill to a mean particle size of between about 400 to 800 microns. They are then ground in the fluid energy mill such as a fluidized bed jet mill or grinder to a mean particle size of between 3 and 30 microns. Such toners have a relatively low density, with a specific gravity of approximately 1.7 for single component and 1.1 for two component toner. They also have a low glass transition temperature, typically less than 70° C. The toner particles will tend to deform and agglomerate if the temperature of the grinding chamber exceeds the glass transition temperature.

In the fluidized bed jet mill or grinder, high velocity fluid, such as air is introduced through 3 to 5 air nozzle devices or nozzles located at the periphery of the grinding chamber and centrally focused. The high velocity air flow from these nozzles entrains and accelerates the particles of material towards the center of the mill. Size reduction is accomplished through the ensuing particle to particle collisions. This method of size reduction has been found to be most effective for size reduction of low-melt compounds typically found in current toner formulations.

In such toner production, size reduction is typically the rate limiting operation as well as having the highest process contribution to the manufacturing cost. Much effort has been concentrated on studying and understanding the size reduction process in order to increase its efficiency and thus maximize throughput rate at minimum cost.

Two factors, the probability of particle to particle collisions and the kinetic energy of these particles during such collisions are understood to affect the efficiency of the size reduction process.

Unfortunately however, fluidized bed jet mills or grinders which are used for such grinding or size reduction of toner particles, have an extremely low energy utilization efficiency. For example, it has been estimated that only 5% of total energy used up by a size reducing fluidized bed jet mill is actually utilized in particle size reduction. Such a low energy utilization efficiency is an opportunity for mill and/or nozzle designs to increase the energy efficiency of the process, thus resulting in significant operating cost savings.

Conventionally, several approaches, including nozzle redesigns have been tried, and continue to be tested for improving grinding energy utilization efficiency and throughput rate of such fluidized bed jet mills or grinders. Improved nozzle designs are directed towards increasing the probability of particle to particle collisions and towards increasing the kinetic energy of particle impacts.

A first type of conventional nozzle consists of a nozzle device having a single bell or flared profile opening or nozzle that discharges a single stream or jet of fluid and has a converging-diverging bell profile. The bell profile includes a converging region, a throat region, and a straight diverging flare region from the throat region to the discharge end.

Another type of conventional nozzle design as disclosed for example in U.S. Pat. No. 5,423,490 consists of a nozzle device having 4 small bell or flared profile openings or nozzles that each can discharge a small jet of fluid, for a total of four such jets. The four jets together then form a single composite jet downstream from the discharge end of the nozzle device. Thus this nozzle works on the concept of subdividing the main nozzle device into 4 smaller focused nozzles that provide the opportunity to entrain more material into the composite jet. As such, it is claimed that relative to the single bell or flared profile opening discharged stream nozzle device, this latter design allows for increased entrainment of particles of material being introduced into the individual fluid jets as they are being discharged from the 4 flared nozzles or openings.

SUMMARY OF THE DISCLOSURE

Thus in accordance with the present disclosure, there is provided a fluidized bed jet mill for grinding particles of material. The fluidized bed jet mill includes plural nozzle devices mounted through side walls into a grinding chamber for discharging a composite stream of high velocity fluid that receives and delivers, for particle to particle collision, entrained particles of material to be ground within the grinding chamber. Each of the nozzle devices includes a plural odd number of bell-like nozzle openings for each discharging an individual stream of high velocity fluid that together form the composite stream of high velocity fluid. Each bell-like nozzle opening comprises (i) a converging region for converging and accelerating a volume of high pressure fluid being moved from a first end to a second end thereof; (ii) a throat region defining a narrowest diameter region of the bell-like nozzle opening; (iii) a first expansion region for producing a linear expansion of the volume of high pressure fluid passing through the throat region, and (iv) a second expansion region for producing a turning expansion as well as a parallel flow of the volume of high pressure fluid coming from the first expansion region. The first expansion region has a radius "r1" and a length "s1" running from the throat region towards the second end, and the radius r1 and length s1 are determined such that (dr1/ds1) is a constant. The second expansion region has a radius "r2" and a length "s2" running from the first expansion region towards the second end, and the radius r2 and length s2 are determined such that (dr2/ds2) is non-linear and is equal to a function of s2.

BRIEF DESCRIPTION OF THE DRAWINGS

In the detailed description of the disclosure below, reference is made to the drawings, in which.

DETAILED DESCRIPTION OF AN EXEMPLARY EMBODIMENT

Figure 1:
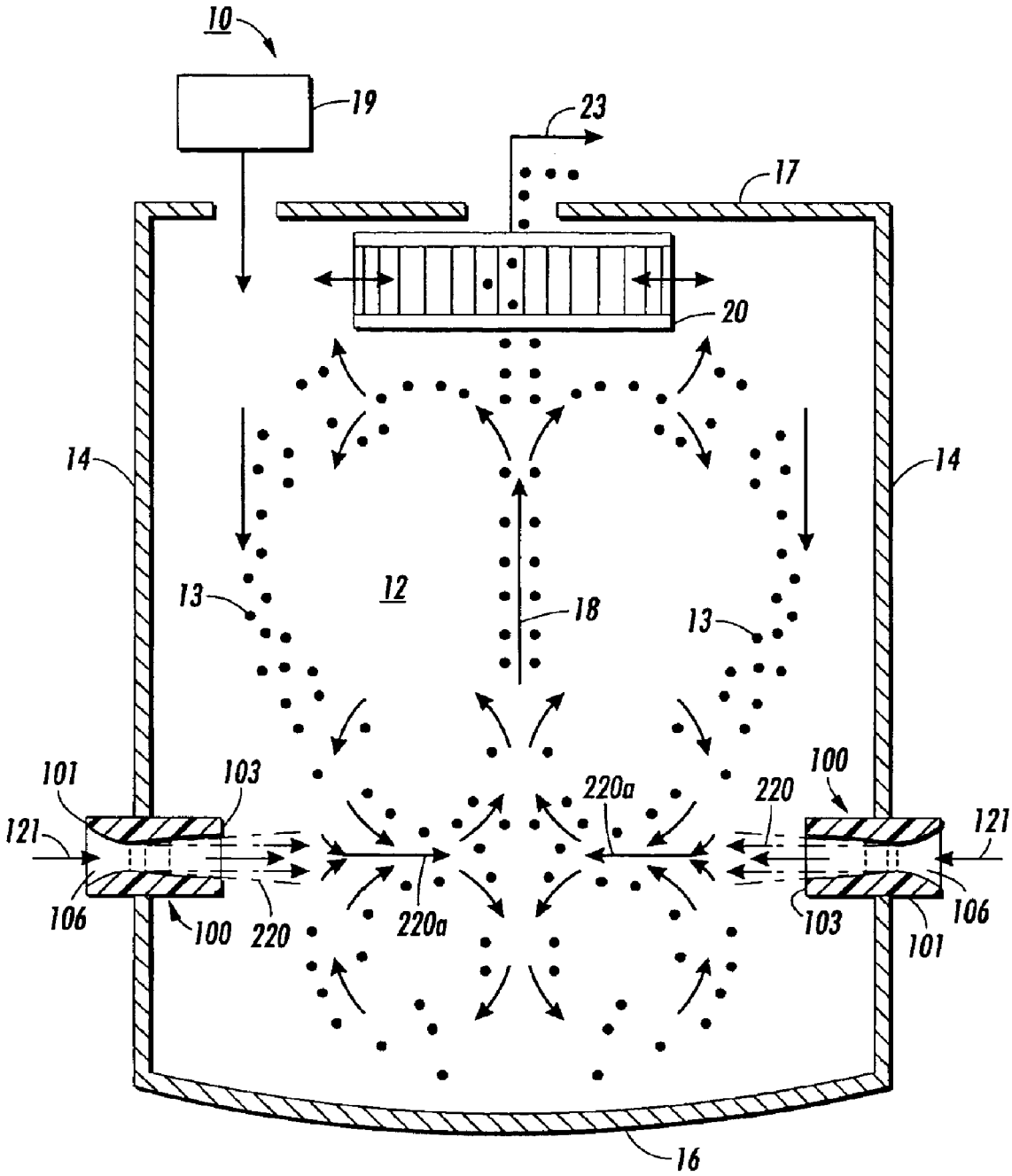
FIG. 1 is a schematic representation in cross section, and in elevation of a fluidized bed jet mill having the plural odd number bell-like openings nozzle device of the present invention.

While the present invention will be described in connection with a preferred embodiment thereof, it will be understood that it is not intended to limit the invention to this embodiments. On the contrary, it is intended to cover all alternatives, modifications, and equivalents as may be included within the spirit and scope of the invention as defined by the appended claims.

Referring to FIGS. 1–12 overall, the present disclosure is directed to a fluidized bed jet mill 10 for grinding particles 13 of material. The fluidized bed jet mill 10 includes (a) a base 16, a top 17 and side walls 14 defining a grinding chamber 12 having a central axis 18; and (b) plural odd number bell-like openings (PONBLO) nozzle devices 100 mounted through the side walls into the grinding chamber for each discharging a composite stream or jet 220 of high velocity fluid 121 towards the central axis 18 of the grinding chamber, and delivering for collision at such central axis, entrained particles 13 of material to be ground.

Each PONBLO nozzle device 100 comprises a cylindrical member 102 having a first end 101, and a second end 103 pointing towards the central axis 18 of the grinding chamber 12, and includes at least a bell-like nozzle opening 106 for discharging the composite stream or jet 220 of high velocity fluid through the second end 103 to entrain the particles 13 of material. As initially fully described on page 9 lines 3–24, and now correspondingly shown in amended FIG. 6, each bell-like nozzle opening 106, 108, 110 includes wall sections that define (i) a converging region 112 for converging and accelerating a volume of high pressure fluid being moved from the first end 101 to be discharged through the second end 103; (ii) a throat region 114 having a narrowest diameter of the bell-like nozzle opening 106; and (iii) a first expansion region 116 adjoining and downstream of the throat region 114 as shown for producing a linear expansion of the volume of high pressure fluid passing through the throat region 114.

The first expansion region 116 as described and now shown has a radius "r1", and a length "s1" that is about the same as a length of the throat region, and that runs from the throat region 114 towards the second end 103, and in this first expansion region, the radius r1 and length s1 are determined such that (dr1/ds1) is a constant. Each bell-like nozzle opening 106 also includes (iv) a second expansion region 118 adjoining and downstream of the first expansion region 116 as shown for producing a turning expansion as well as a parallel flow of the volume of high pressure fluid from the first expansion region 116. The second expansion region 118 as described and now shown has a radius "r2", and a length "s2" that as shown is significantly greater than the length s1 of the first expansion region 116, and that runs from the first expansion region 116 towards the second end 103, and in this second expansion region the radius r2 and length s2 are determined such that (dr2/ds2) is not a constant but is non-linear and equal to a function of s2.

As illustrated, each PONBLO nozzle device 100 is described as having a "plural odd number of bell-like openings" (PONBLO) because the cylindrical member 102 includes a longitudinal axis 104 and a plural odd number (3) of the bell-like nozzle opening 106, 108, 110. Each of the bell-like nozzle opening 106, 108, 110 of the plural odd number is located a distance DS from the longitudinal axis 104 and has a diameter DM. In one embodiment, the distance DS is equal in dimension to one half each diameter DM of each bell-like nozzle opening 106, 108, 110, and so defines a circle 105 having a diameter 2×DS. Each bell-like nozzle opening of the plural odd number is suitable for discharging an individual stream 122, 124, 126 of high pressure fluid 121. Each individual stream 122, 124, 126 has a stream axis 122*a*, 124*a*, 126*a* that is coincident with the axis of the nozzle opening, and is declined, that is slanted inwards such that it intersects the longitudinal axis 104 of the cylindrical member 102, and hence of the PONBLO nozzle device 100. When the nozzle device 100 is mounted through the side walls 14 of a fluidized jet mill or grinder 10, each of the individual stream axis 122*a*, 124*a*, 126*a* will intersect the longitudinal axis 104 of the nozzle device 100 at a point that is located between the central axis 18 of the grinding chamber 12 and the second end 103 of the nozzle device 100.

Figure 5A:
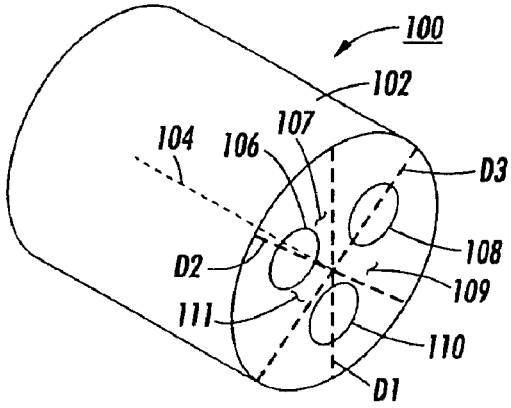
FIG. 5 is a perspective schematic of the plural odd number bell-like openings (PONBLO) nozzle device in accordance with the present disclosure.
Figure 5B:
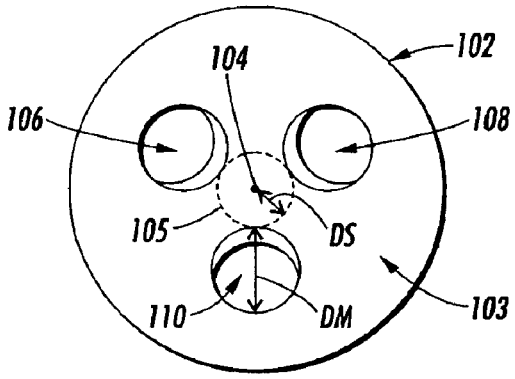

Further, on each of the PONBLO nozzle devices 100, adjacent bell-like nozzle openings 106,108; 108, 110; and 110, 106 define or border a space or gap 107, 109, 111 that lies between them as shown in FIG. 5A, and that acts as a particle receiving gap during operation of the nozzle device. Each gap, space or particle receiving space 107, 109, 111 is located opposite to, and on a common diameter D1, D2, D3 with, one of the plural odd number of the bell-like nozzle opening 106, 108, 110 as shown in FIG. 5A. As such, each nozzle device 100 includes a plural odd number of the particle receiving spaces 107, 109, 111 that are each directly across the longitudinal axis 104 from an individual stream 122, 124, 126 of high pressure fluid. Such an arrangement allows for particles 13 to move easily through a gap or space 107, 109, 111 (each acting as a particle receiving space) towards the center (axis 104) near the second end 103 of the nozzle device 100, but each of the individual streams 122, 124, 126 does not allow for such particles to move back out from such center. Such particles therefore become entrained first by the individual streams 122, 124, 126, and eventually by the composite stream 220 downstream from the nozzle device.

Referring specifically now to FIG. 1, the fluidized bed jet mill 10 comprises the grinding chamber 12 having the peripheral walls 14, the base 16, top 17, the central axis 18, and the plurality of sources 100 of particle entraining high pressure high velocity composite fluid stream or jet 220. Each source of the plurality of sources 100 as shown is mounted through the peripheral or side walls 14 and extends into the grinding chamber 12 so that they are arrayed symmetrically about the central axis 18. Additionally, the sources or nozzles 100 are oriented for each directing the stream or jet 220 of the high pressure high velocity fluid along a composite stream axis 220*a* that is coincident with the longitudinal axis 104 of the nozzle device 100. As mounted, the longitudinal axis 104 of each nozzle device 100 is substantially perpendicular to, as well as intersects the central axis 18 of the grinding chamber 12. The central axis 18 as such is thus situated at and may comprise the point of intersection of the fluid streams 220, and hence the focal point for particle to particle collisions and breakage region.

As further illustrated, the fluidized jet mill 10 also includes a particle classifying and discharging device 20 mounted towards the top 17 thereof. In operation, the mill 10 fluidizes and circulates particles 13 of material that are continually introduced by apparatus 19, either from the top 17 as shown, or from the bottom of the chamber. The particle breakage or grinding region is located around the intersection of the composite streams 220 where the entrained particles impinge against each other and are fragmented. Larger particles tend to fall back or are rejected by the classifier 20, and are thus returned for entrainment by the composite streams 220, Meanwhile, particles that have been broken to an acceptable small size are pulled in by the classifying device 20 for transfer to particle collector outlet 23.

Figure 2:
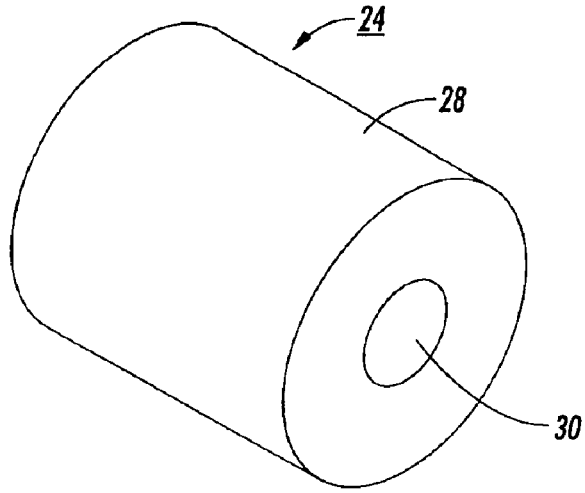
FIG. 2 (PRIOR ART)
FIG. 2 is a perspective schematic of a first type of conventional nozzle device having a single conventional flared profile nozzle opening.
Figure 3:
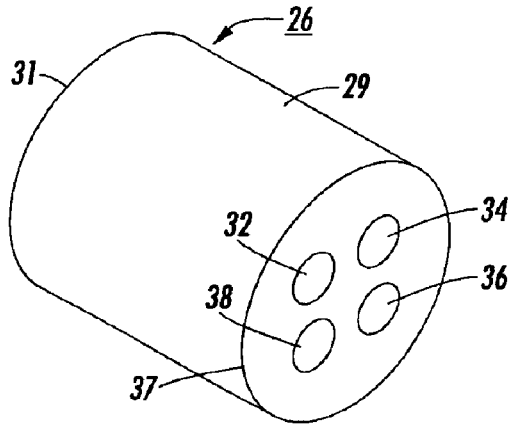
FIG. 3 (PRIOR ART)
FIG. 3 is a perspective schematic of a second type of conventional nozzle device having four conventional flared profile nozzle openings.
Figure 4:
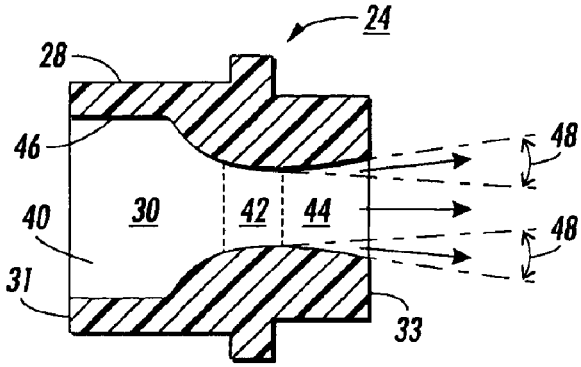
FIG. 4 (PRIOR ART)
FIG. 4 is a schematic representation in cross-section of a conventional flared profile nozzle opening as in FIGS. 2 and 3.

Referring now to FIGS. 2–4, perspective schematics of a first type 24 and a second type 26, of conventional nozzle devices are shown in FIGS. 2 and 3. The first type 24 of device comprises a cylindrical member 28 having a single flared profile nozzle opening 30, and the second type 26 comprises a cylindrical member 29 that has four conventional flared profile nozzle openings 32, 34, 36, 38. In both types 24, 26, each nozzle opening 30, 32, 34, 36, 38, has a conventional flared profile as shown in cross-section in FIG. 4. A conventional flared profile nozzle opening, e.g. 30, includes three basic regions, namely, a converging region 40, a narrow throat region 42, and a diverging region 44. In use or operation, a pressurized fluid or fluid that is flowing through the entire nozzle opening first passes through the converging region 40, and next through the throat region 42 and then finally through the diverging region 44. From the throat region 42, the walls 46 defining the nozzle opening 30, 32, 34, 36, 38, diverges immediately at a relatively large divergent angle 48.

Referring now to FIGS. 2–4, and 7–8, when mounted for use within a fluidized bed jet mill 10, for example, the first type 24 of conventional nozzle device (FIG. 2), will discharge a single fluid stream 50 that expands around a common nozzle/stream axis 50*a*. On the other hand, the second type 26 of conventional nozzle device (FIG. 3), will discharge four individual fluid streams 52, 54, 56, 58 (FIG. 8) that each expand to form a composite stream 60 around a common nozzle member-composite stream axis 60*a*.

Figure 7:
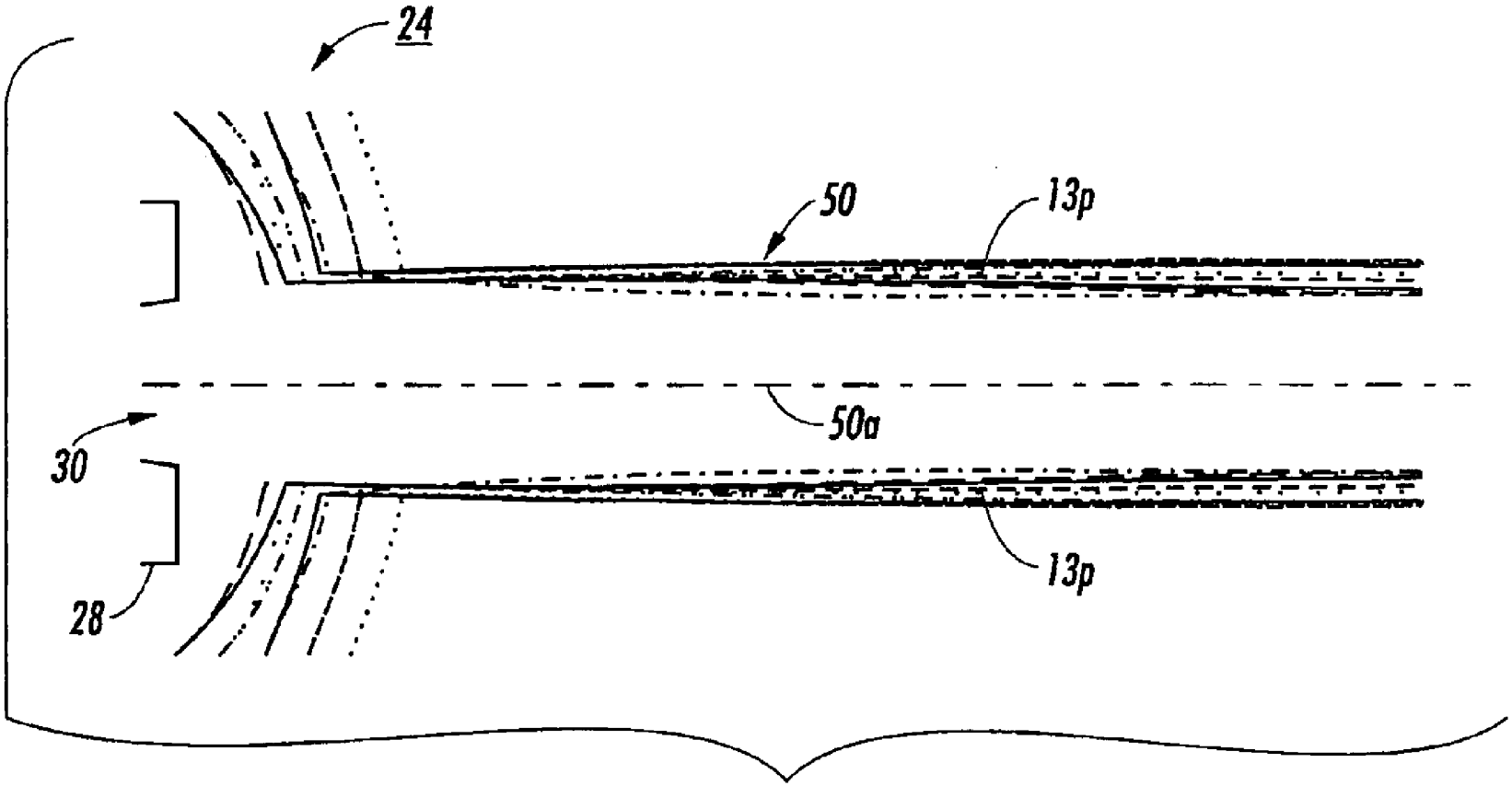
FIG. 7 (PRIOR ART)
FIG. 7 is a schematic simulation diagram of particle entrainment by the single fluid stream of the conventional nozzle device of FIG. 2, that is, the first type of conventional nozzle device having the single conventional flared profile nozzle opening.
Figure 8:
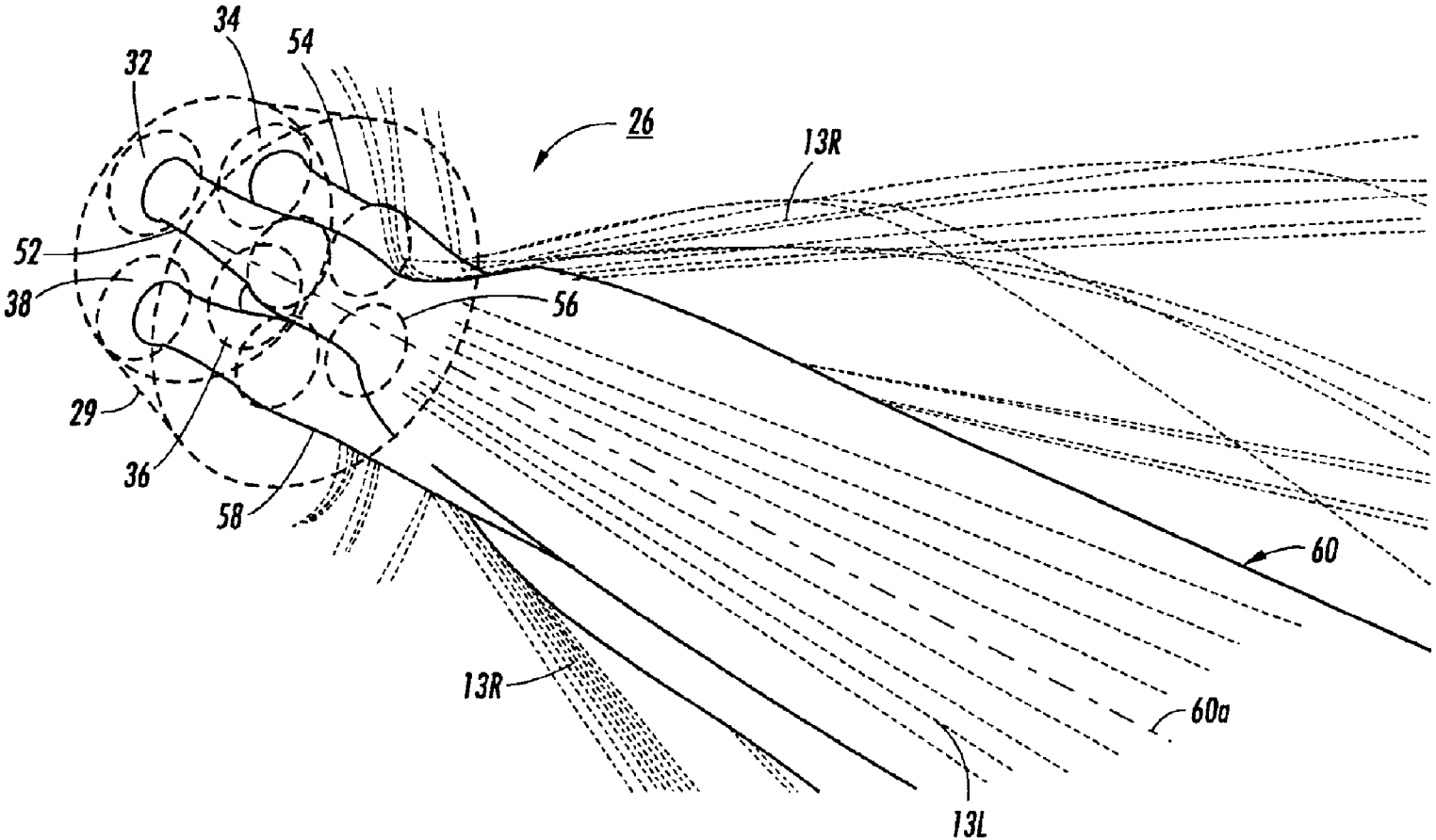
FIG. 8 (PRIOR ART)
FIG. 8 is a schematic simulation diagram of particle entrainment by the fluid streams of the conventional nozzle device of FIG. 3, that is, the second type of conventional nozzle device having four conventional flared profile nozzle openings.
Figure 9:
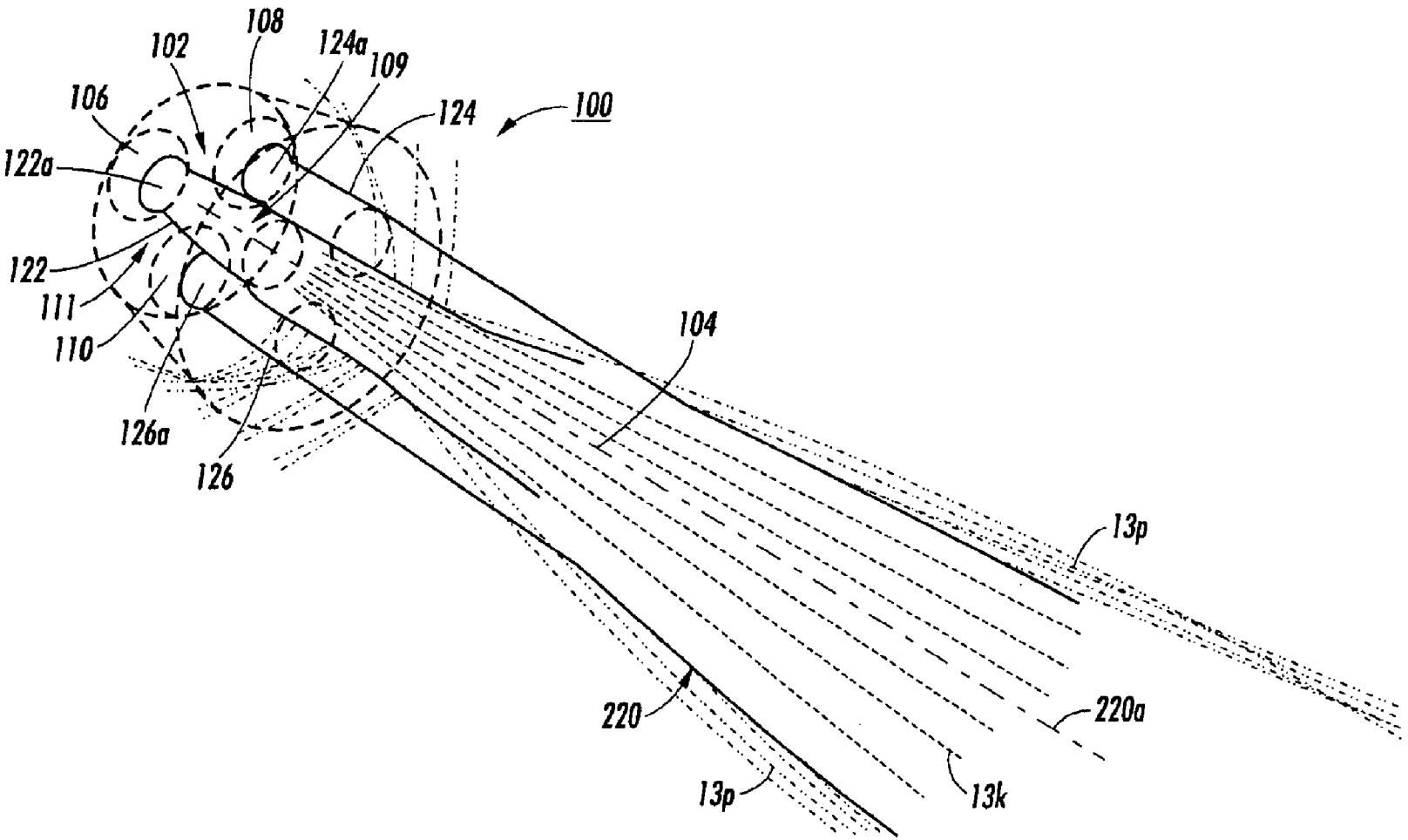
FIG. 9 is a schematic simulation diagram of particle entrainment by the fluid stream of the plural odd number bell-like openings (PONBLO) nozzle device in accordance with the present disclosure.

Particle entrainment by the single fluid stream 50 of the first type 24 of conventional nozzle device of FIG. 2 is illustrated in FIG. 7 using a schematic simulation diagram. Similar particle entrainment is illustrated in FIG. 8 for the second type 26 of conventional nozzle device of FIG. 3 which has four conventional flared profile nozzle openings 32, 34, 36, 38.

Referring now to FIGS. 5A, 5B, 6 and 9, the PONBLO (plural odd number bell-like openings) nozzle device of the present disclosure is shown generally as 100 and comprises a cylindrical nozzle device 102 having a longitudinal axis 104 and a plural, odd number of nozzle openings or nozzles for example 106, 108, 110 that are formed around the longitudinal axis 104. The cylindrical member 102 includes the longitudinal axis 104 and a plural odd number (3) of the bell-like nozzle opening 106, 108, 110. Each of the bell-like nozzle opening 106, 108, 110 of the plural odd number is located a distance DS from the longitudinal axis 104 and has a diameter DM. In one embodiment, the distance DS is equal in dimension to one half each diameter DM of each bell-like nozzle opening 106, 108, 110, and so defines a circle 105 having a diameter 2×DS.

The odd number of nozzles 106, 108, 110 each can discharge a small jet or stream 122, 124, 126 of fluid, which together then form a composite stream or jet 220, downstream from the discharge end 103 of the nozzle device or member 102. One embodiment of the plural, odd number of nozzles, for example consists of three nozzles.

Use of an odd number of nozzle openings or nozzles, for example three nozzles openings 106, 108, 110, per nozzle device 102 as shown in the one embodiment, results in nozzles, and hence discharging fluid jets or streams 122, 124, 126, that are relatively more widely spaced by spacings 107, 109 and 111, one from the others per nozzle device 102. The relatively wider spacings 107, 109 and 111 as shown are defined by adjacent nozzles 106 and 108, 108 and 110, and 110, 106, and effectively comprise low velocity regions at the discharge end 103. The low velocity regions (107, 109, 111) serve as effective introduction gaps for introducing particles 13 of material (to be comminuted) towards the central axis 104 (220*a*), and hence into a region towards the center of the three or odd number of individual jets 122, 124, 126 from the plural, odd number of nozzles 106, 108, 110.

Because of the plural odd number of nozzles 106, 108, 110, there are also an equal plural odd number of such gaps 107, 109, 111, each of which is located opposite and across (the longitudinal axis) from one of the plural, odd number of nozzles 106, 108,110. As such, each particle of material introduced through a gap or spacing 107, 109, 111 towards the longitudinal axis 104 of the nozzle device 102 is more likely to be trapped therein by an individual stream 122, 124, 126 from the opposing nozzle, and is also clearly less likely simply to pass through. Such trapping is believed to significantly increase the probability of entrainment of such particles by the composite jet or stream that then forms from the odd number of individual jets 122, 124, 126.

Additionally, each nozzle 106,108,110 of the plural odd number of nozzles has a bell-like shape or profile (FIG. 6) that includes a converging region 112, a throat region 114, a straight, first expansion region 116, and a non-straight second expansion region 118 that extends from the first expansion region 116 to the discharge end 103 thereof.

This combination of nozzle spacings 107, 109, 111 and the bell-like profile, increases both the internal and external entrainment area, while still maintaining a high velocity and high kinetic energy for entrained particles towards their impact point near the center 18 (FIG. 1) of the mill 10. Computational Fluid Dynamics (CFD) simulation (FIG. 9) confirms the ability of this PONBLO nozzle device 100 to exceed the entrainment ability of each of the first and the second types 24, 26 of conventional flared profile nozzles. Such simulation also confirms that the PONBLO nozzle device 100 also maintains a relatively higher downstream velocity (FIG. 12), as well as downstream kinetic energy within the mill 10 (FIG. 1).

Figure 6:
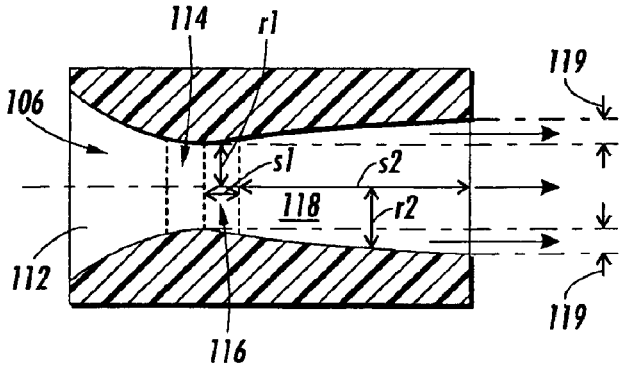
FIG. 6 is a schematic representation in cross-section of one bell-like nozzle opening of the plural odd number bell-like nozzle openings of the (PONBLO) nozzle device of FIG. 5.

An exemplary embodiment of the PONBLO nozzle device 100 consists of 3 focused nozzles or opening 106, 108, 110, each with a bell-like shaped diverging contour or profile (FIG. 6). With the PONBLO nozzle device 100 using only 3 nozzles or openings 106, 108, 110, it is believed that it increases the intra-nozzle spacing 107, 109, 111 thus increasing the probability of particles moving towards the center 104 of the nozzle member 102, and the capacity of the composite stream or jet 220 to entrap and entrain particles 13. The bell-like shaped or profile with its differing first and second expansion regions 116, 118, results in fluid and entrained particle flow that is totally parallel to each axis 122*a*, 124*a*, 126*a* of the individual streams 122, 124, 126 from openings 106, 108, 110 of each nozzle device 100. The resulting parallel flow maximizes the kinetic energy of the composite stream 220 towards the collision plane 18 (FIG. 1), as well as further increasing the entrainment ability of the composite stream or jet 220.

CFD simulation was used to compare the performance of the PONBLO nozzle device 100 of the present disclosure to that of each of the first and second types 24, 26 of conventional nozzle devices as described above. In the CFD simulation, the flow field was descretized and solved based on the conservation of mass, momentum, and energy for the fluid flow field and given boundary conditions. Thus, a converged CFD solution is typically representative of the actual flow. As a basis for the comparison of nozzle performance, the nozzles were initially compared using several numerical metrics, such as input pressure, output pressure, exit diameter, thrust, average velocity at the exit end and at a non-dimensional distance of x/d=20 from the exit end.

The results of the comparison show clearly that for equal mass flux, the PONBLO nozzle device 100 results in a relatively higher thrust and average velocity at the nozzle device discharge end than either the first type or second type 24, 26 of conventional flared opening nozzle devices.

Figure 10:
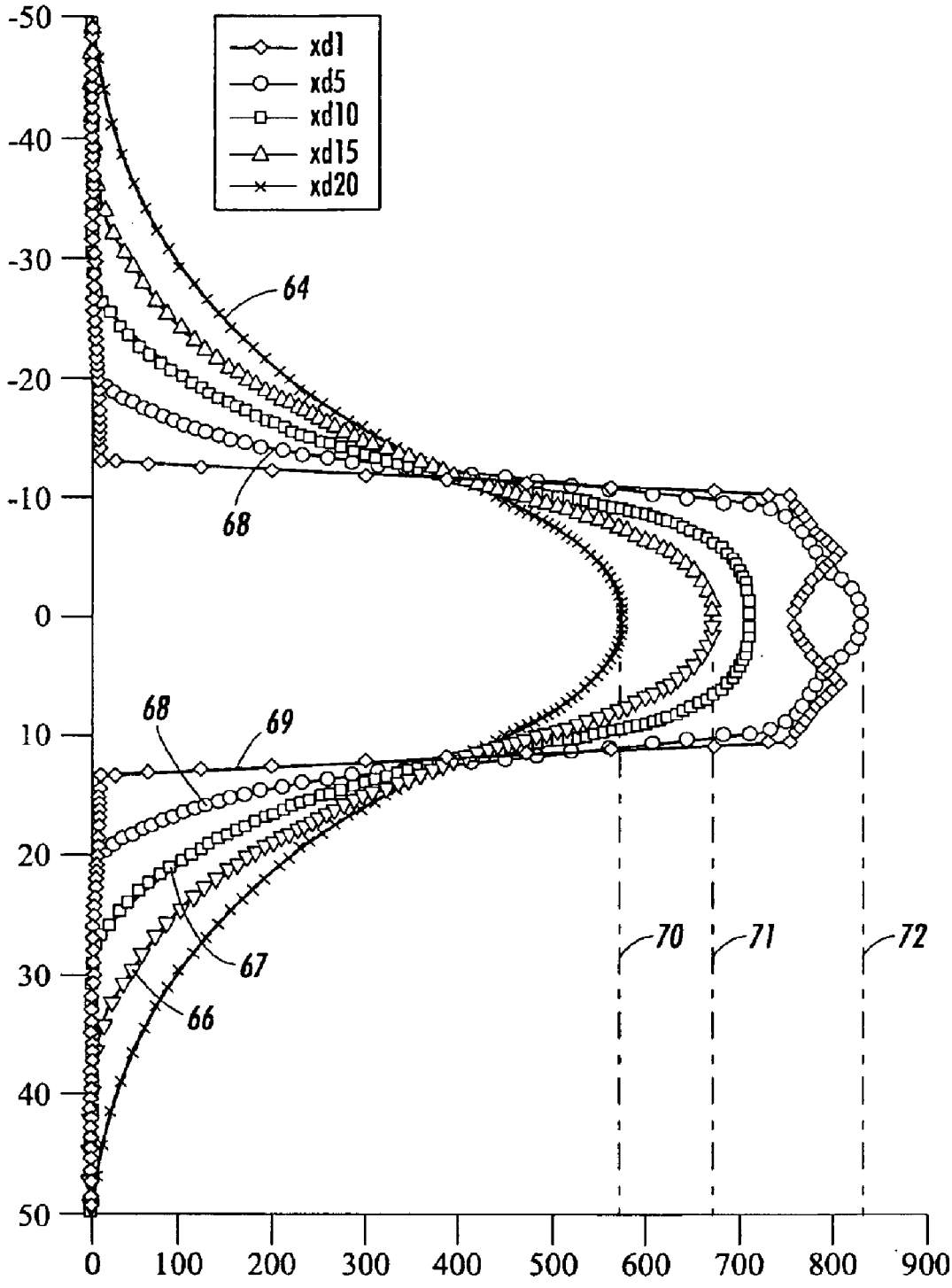
FIG. 10 (PRIOR ART)
FIG. 10 is a graphical illustration of a plot of velocity profiles, of a conventional flared profile nozzle opening in the conventional nozzle device of FIG. 2, at non-dimensional distances of 1, 5, 10, 15, and 20 from the nozzle device discharge end.
Figure 11:
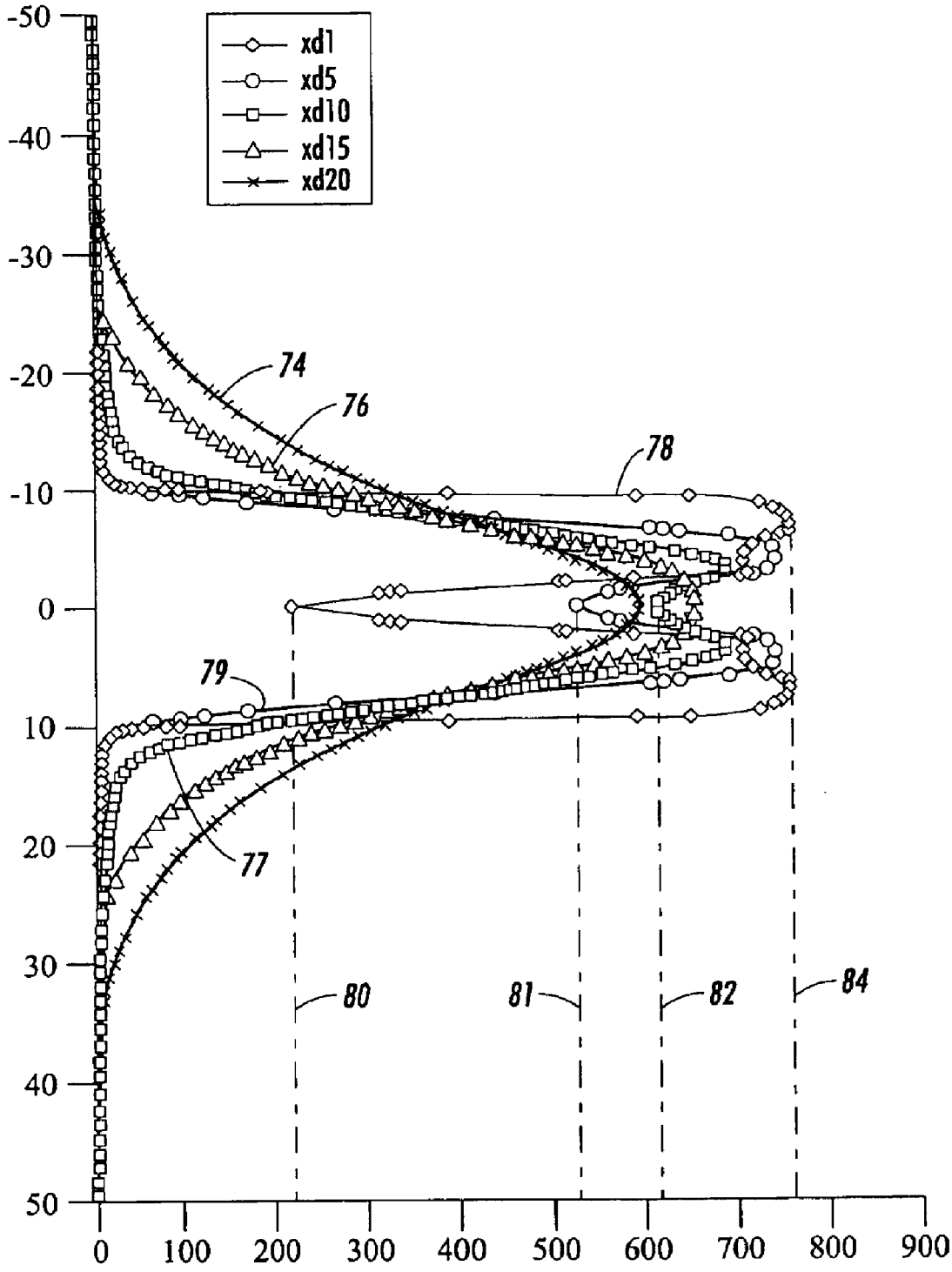
FIG. 11 (PRIOR ART)
FIG. 11 is a graphical illustration of a plot of velocity profiles, of a composite stream from the even number of conventional flared profile nozzle openings in the conventional nozzle device of FIG. 3, at non-dimensional distances of 1, 5, 10, 15, and 20 from the nozzle device discharge end.
Figure 12:
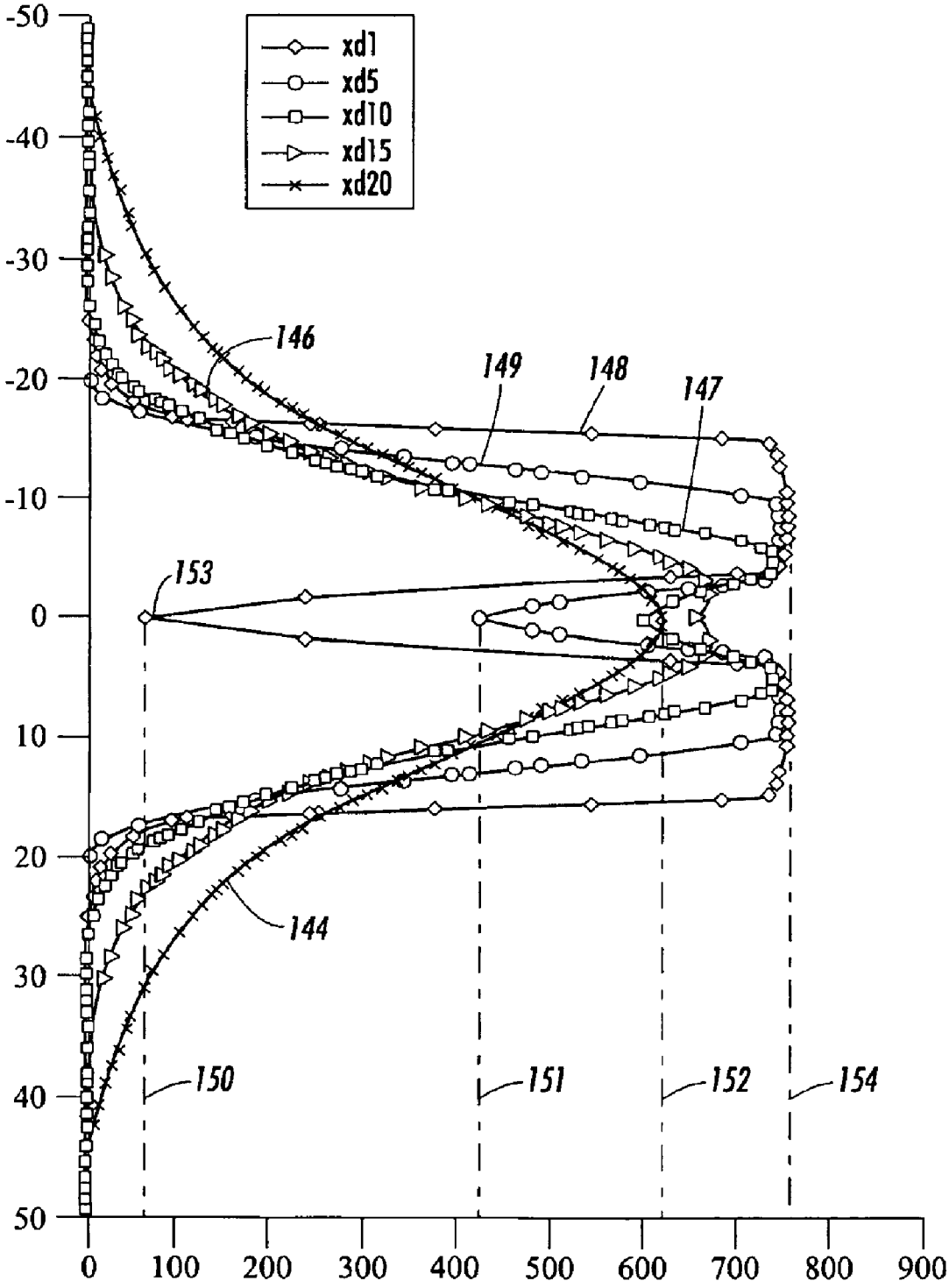
FIG. 12 is a graphical illustration of a plot of velocity profiles, of a composite stream from the odd number of bell-like profile nozzle openings in the nozzle device of FIG. 5, at non-dimensional distances of 1, 5, 10, 15, and 20 from the throat.

Referring next to FIGS. 10, 11, and 12, further comparison of the nozzles can be seen in the examination of velocity profile plots across the nozzle diameter of each nozzle opening, and at different non-dimensional distances from the exit end, e.g. end 103, of each nozzle device or member 102. FIGS. 10–12 show such velocity profiles at non-dimension distances of 1, 5, 10, 15, and 20 from such exit end for each nozzle. The non-dimensional distance is a multiple of "equivalent throat diameter" for each nozzle device. The "equivalent throat diameter" for a nozzle device is defined as the diameter which yields equivalent total surface area for all nozzle openings.

In general, FIGS. 10–12 show the velocity profiles of the jet emanating from the nozzle device as a function of distance from the nozzle discharge end, for example, 103. The velocity profiles are determined using CFD (Computational Fluid Dynamics) simulation. The x-axis is the velocity towards the center of the chamber and is given in meters/second. The y-axis is the lateral distance (in mm) from the longitudinal axis 104. Each line series shows a jet velocity profile at a non-dimensional interval 'x/d' from the nozzle, where 'x' is the distance from the nozzle discharge end 103 and 'd' is the equivalent throat diameter of the nozzle device. The "equivalent throat diameter" of a device is defined as the opening diameter which yields equivalent surface area as the sum of surface area for all openings. The general trend is for the core of the jet to decrease in velocity at greater distances from the nozzle as the jet mixes with the surrounding fluid, entraining and accelerating particles for comminution.

Specifically FIG. 10 shows velocity profiles for first type of conventional nozzle device having a single flared profile opening. What is shown is as follows: the velocity profile 64 at X/D=20; the velocity profile 66 at X/D=15; the velocity profile 67 at X/D=10; the velocity profile 68 at X/D=5; the velocity profile 69 at X/D=1; the Maximum jet velocity 70 at X/D=20; the Maximum jet velocity 71 at X/D=15; and the Maximum jet velocity 72 at x/D=1. These velocity profiles are taken across the nozzle longitudinal axis 104 as the jet progresses downstream from the discharge end 33 of the nozzle. At X/D=1 the jet has an extreme velocity gradient to the surrounding fluid at about 12 mm lateral distance from the longitudinal axis 104. As the jet passes downstream through X/D=5, 10, 15, and 20 (and as seen in elements 70–72) there is more mixing of the jet with the surrounding fluid as both air and particles are entrained into the flow, the maximum velocity of the jet decreases and the jet tends to broaden. Relative to the invention, the particles can only be entrained along the periphery of the jet and do not mix into the center.

FIG. 11 shows velocity profiles for the second type of conventional nozzle device having four conventional flared profile openings. What is shown is as follows: 74 is velocity profile at X/D=20; 76 is velocity profile at X/D=15; 77 is velocity profile at X/D=10; 78 is velocity profile at X/D=5; 79 is velocity profile at X/D=1; 80 is lowest jet velocity at X/D=1; 81 is lowest jet velocity at X/D=5; 82 is Maximum jet velocity at X/D=20; and 84 is Maximum jet velocity at X/D=1.

The velocity profiles for FIG. 11 are shown as a function of lateral distance from the longitudinal axis. Of particular interest are elements 80-82, which show the collapse of the velocity 'pocket' between the jets as each jet spreads into the surrounding flow. In theory, this velocity pocket should allow material to be entrained into the center of the jet, resulting in increased jet loading. However at X/D=1, element 80, the minimum pocket velocity is already in excess of 200 m/s suggesting that there is little opportunity for additional material entrainment. The is verified by the particle tracking studies which show poor entrainment into the center of the jet.

FIG. 12 shows velocity profiles for the PONBLO nozzle device of the present disclosure, which are as follows: 144 is velocity profile at X/D=20; 146 is velocity profile at X/D=15; 147 is velocity profile at X/D=10; 148 is velocity profile at X/D=5; and 149 is velocity profile at X/D=1; 150 is lowest jet velocity at X/D=1; 151 is lowest jet velocity at X/D=5; 152 is Maximum jet velocity at X/D=20; 153 is lowest jet velocity at X/D=1; and 154 is Maximum jet velocity at X/D=1.

Again, the velocity profiles in FIG. 12 are shown as a function of lateral distance from the longitudinal axis 104. An immediate observation as seen in element 147–149 is the broader jet dimension, which translates into greater circumferential area for particle entrainment. Element 153 shows that the initial velocity pocket at X/D=1 extends down to about 75 m/s. Element 151 shows that the velocity has longer downstream persistence than comparable locations of FIG. 11. The larger velocity pocket and the spacing of the odd number of nozzles, results in higher entrainment opportunity for the PONBLO nozzle design. Comparison of particle entrainment confirms the superior entrainment ability of the PONBLO nozzle design over the nozzle profiles shown in FIG. 10 and FIG. 11.

Lastly, element 152 shows that even though the entrainment ability of the PONBLO design has been increased, the maximum downstream velocity at X/D=20 is equivalent to both the other conventional nozzle designs. This feature assures that there is sufficient particle momentum for breakage at the higher entrainment level. Higher downstream momentum for the PONBLO design is a direct result of the non-linear contour design previously described, wherein fully expanded parallel exit flow results in equivalent or higher downstream momentum even at increased entrainment levels.

Comparing the velocity profile (FIG. 10) of the standard or first type of conventional nozzle 24 with that (FIG. 11) of the second type of conventional nozzle 26, it can be seen that in the case of the second type of conventional nozzle 26, a low velocity region or "pocket" is exhibited in the proximity of the exit area or end 33 of the nozzle member 29 where the non-dimensional distance (x/d) is less than 10. This low velocity region or pocket 62 does operate to allow more particles (than in the case of the first type 24) to move towards the axis of the nozzle member, and thus increase their probability of being entrained within the center 60*a* of the composite jet 60, thus increasing the jet loading. There is no such path for internal entrainment in the case of the standard or first type of conventional.

With particular reference to FIG. 12, a similar comparison with similarly taken velocity profiles of the PONBLO nozzle device 100, also exhibits a low velocity region or pocket 153 that has a wider width 134, and extends for a longer distance 136 than even the similar velocity pocket 62 of the second type of conventional nozzle 26. This larger low velocity pocket or region 153 thus enables relatively greater particle reception and internal entrainment as compared to the case of the second type of conventional nozzle 26. The PONBLO nozzle device 100 also has a wider cross sectional area 140 for the composite stream 220, thus also resulting in a greater peripheral area, which together result in relatively more or greater entrainment of particles of material internally and peripherally when compared to either the case of the standard or second type 24, 26 of conventional nozzle. The downstream velocity 142 of the PONBLO nozzle device at the non-dimensional distance (x/d)=20 is similar but clearly slightly higher than that at the same distance for either the standard or second type 24, 26 of conventional nozzle.

As a final comparison, particle tracking simulations were done at different points in the vicinity of each nozzle, and resulting particle tracks show the effective entrainment of the different nozzle designs. A particle density of 1200 kg/m^3 was used on all cases. Five (5) particle sizes were tracked in each group; 10, 32.5, 55, 77.5, and 100 microns. This density and particle sizes represent typical particles encountered in the jet mill. All particle groups were released at 30 mm above the central axis of the nozzle. Particle groups were released at axial distances of 0, 5, 10, 15, and 20 mm from exit plane of the nozzle.

Referring still to FIGS. 10, 11 and 12, the results of the particle tracking simulation show large differences among the different nozzle designs. Nozzle devices having a single nozzle or opening such as the first type 24 of conventional nozzle device (FIG. 2), tend to result in particles 13P riding along the periphery of the single jet or stream 50 of fluid. While the second type 26 of conventional nozzle (FIG. 3) shows some ability to entrain material 13L into the center of the composite stream or jet 60, a significant quantity of particles 13R tend however to be undesirably accelerated radially away from the composite stream 60. In contrast, the PONBLO nozzle device 100 (FIG. 5) is better able to entrain particles 13K at longer distances from the end 103 of the nozzle, as well as better able to pull these particles 13K into the center of its composite stream or jet 220. This results in an increased number of high-energy particle-to-particle collisions, and thus in relatively higher particle breakage rates and increased energy utilization efficiency.

The high entrainment and high acceleration of the PONBLO nozzle device 100 result in relatively high strain rate collisions which will cause efficient particle breakage and size reduction. With respect to the second type 26 of conventional nozzle device, it has been found that while its multiple jets or streams 52, 54, 56, 58 tend to result in some increases in particle entrainment downstream, the relatively lower velocity, lower entrainment and lower kinetic energy thereof tend to make them effective only for the size reduction of brittle materials. The PONBLO nozzle device 100 on the other hand results in relatively higher entrainment of particles, while maintaining a high collision energy level that enables efficient size reduction of even tougher materials such as polymer materials.

In a reduction to practice example, a set of 5 15 mm PONBLO nozzle devices 100 was built from stainless steel using CNC cutting machines. The PONBLO nozzle devices 100 were evaluated. For the trial, the comparison nozzle was a high compression (HC) type nozzle which has a single flared profile opening such as 30, very similar to that of the standard or first type 24 of conventional nozzle device (FIG. 2). The main difference is that the HC nozzle has a longer length and so has a diverging region 44 that is designed for full expansion. The HC type nozzle showed about a 10% increase in throughput rate over the standard design for several color toner formulations and size requirements.

For the control run, the conventional (i.e. HC) nozzles were located at a distance of a/d=19.7 from the center of the grinding chamber 12. The second type 26 of conventional nozzle has usually been located at a/d=17, so the PONBLO device was tried at a/d=18.3 and a/d=17.

The PONBLO nozzle device 100 when located at a/d=18.3 in a fluidized jet mill and operated, resulted in power consumption, that in an average total amps, was relatively significantly lower due to conservative operation of the grinder for this run. The total amps is an indicator of the amount of fluidized material, so that a low total amps is an indicator that the throughput rate was not maximized for this run. The PONBLO nozzle device located at a/d=17 had a closer total amps level of power consumption, so the comparison of the relevant conventional nozzle devices and the PONBLO nozzle device performances showed that at the same energy input, the PONBLO nozzle device 100 resulted in an 11% throughput rate increase over the HC nozzle device.

This is so even though the HC nozzle device has been found to consistently show a 9–10% rate increase when compared to the standard or first type 24 of conventional nozzle device (FIG. 2). Therefore at least a 20% throughput rate increase results from using the PONBLO nozzle device when compared to the standard or first type of conventional nozzle device. Furthermore, when using the PONBLO nozzle devices, the chamber pressure in the grinding chamber is found to be lower (−0.2 psig) when compared to that for the HC nozzle device. This clearly suggests that a different fluidization pattern is indeed causing the throughput rate increase in the case of the PONBLO nozzle device.

The PONBLO nozzle device 100 is therefore an optimized nozzle design from CFD simulation. It results in a significant increase in particle entrainment as well as in particle collision energy, and it achieves a relatively high size reduction throughput rate per unit energy input.

As can be seen there has been provided a fluidized bed jet mill for grinding particles of material. The fluidized bed jet mill includes plural nozzle devices mounted through side walls into a grinding chamber for discharging a composite stream of high velocity fluid that receives and delivers, for particle to particle collision, entrained particles of material to be ground within the grinding chamber. Each of the nozzle device includes a plural odd number of bell-like nozzle openings for each discharging an individual stream of high velocity fluid that together form the composite stream of high velocity fluid. Each bell-like nozzle opening comprises (i) a converging region for converging and accelerating a volume of high pressure fluid being moved from a first end to a second end thereof; (ii) a throat region defining a narrowest diameter region of the bell-like nozzle opening; (iii) a first expansion region for producing a linear expansion of the volume of high pressure fluid passing through the throat region, and (iv) a second expansion region for producing a turning expansion as well as a parallel flow of the volume of high pressure fluid coming from the first expansion region. The first expansion region has a radius "r1" and a length "s1" running from the throat region towards the second end, and the radius r1 and length s1 are determined such that (dr1/ds1) is a constant. The second expansion region has a radius "r2" and a length "s2" running from the first expansion region towards the second end, and the radius r2 and length s2 are determined such that (dr2/ds2) is non-linear and is equal to a function of s2.

While the present invention has been described in connection with a preferred embodiment thereof, it is understood that it is not intended to limit the invention to this embodiment. On the contrary, it is intended to cover all alternatives, modifications, and equivalents as may be included within the spirit and scope of the invention as defined by the appended claims:

What is claimed is:

1. A nozzle device for mounting through side walls of a fluidized bed jet mill to discharge a composite stream of high velocity fluid for receiving, entraining and delivering particles of material into a grinding chamber of the fluidized bed jet mill for particle to particle collision, said nozzle device having a first end, and a second end pointing towards a central axis of the grinding chamber when mounted through said side walls, and said nozzle device including a plural odd number of nozzle openings for each discharging an individual stream of high velocity fluid that together form said composite stream, each said nozzle opening having a nozzle axis and including:

(i) a converging region defined by a first nozzle wall section located towards said first end for converging and accelerating a volume of high pressure fluid into said individual stream of high velocity fluid;

(ii) a throat region defined by a second nozzle wall section comprising a point of narrowest diameter of said nozzle opening;

(iii) a first expansion region for producing a linear expansion of said volume of high pressure fluid passing through said throat region, said first expansion region including a third nozzle wall section having an increasing radius "r1", and an increasing length "s1" running from said throat region towards said second end, and said radius r1 and said length s1 being determined such that (dr1/ds1) is a constant; and (iv) a second expansion region for producing a turning expansion and a parallel flow of said volume of high pressure fluid from said first expansion region, said second expansion region including a fourth nozzle wall section having an increasing radius "r2" and an increasing length "s2" significantly greater than the length s1 of the first expansion region and running from said first expansion region towards said second end, and said radius r2 and said length s2 being determined such that (dr2/ds2) is equal to a non-linear function of s2.

2. The nozzle device of claim 1 wherein said nozzle device is cylindrical and includes a longitudinal axis and said plural odd number of nozzle openings is three.

3. The nozzle device of claim 2 wherein each nozzle opening of said plural odd number of nozzle openings is located a distance DS from said longitudinal axis.

4. The nozzle device of claim 2 wherein each nozzle opening of said plural odd number of nozzle openings has a nozzle axis slanted at 3 degree towards a longitudinal axis of the nozzle device such that each said nozzle axis thereof intersects said longitudinal axis of said nozzle device.

5. The nozzle device of claim 2 wherein adjacent nozzle openings of said plural odd number of nozzle openings border a space between them for receiving particles during operation of the nozzle device.

6. The nozzle device of claim 3 wherein each nozzle opening of said plural odd number of nozzle openings has a diameter DM and said distance DS is within a range of 0.4 through 0.7 times DM and most preferably half DM.

7. The nozzle device of claim 4 wherein when said nozzle device is mounted through said side walls, each said nozzle axis thereof intersects said longitudinal axis of said nozzle device at a point between said central axis of said grinding chamber and said second end of said nozzle device.

8. The nozzle device of claim 5 wherein each said space between adjacent said nozzle openings is located opposite to, and on a common diameter with, one of said plural odd number of said nozzle openings.

9. The nozzle device of claim 5 including a plural odd number of said spaces for receiving particles during operation of the nozzle device.

10. A fluidized bed jet mill for grinding particles of material comprising:

(a) a base, a top and side walls defining a grinding chamber having a central axis; and (b) plural nozzle devices mounted through said side walls into said grinding chamber for discharging a composite stream of high velocity fluid to receive and deliver, for particle to particle collision, entrained particles of material to be ground within said grinding chamber, each said nozzle device including a plural odd number of bell-like nozzle openings for each discharging an individual stream of high velocity fluid for together forming said composite stream of high velocity fluid, each said bell-like nozzle opening including:

(i) a converging region for converging and accelerating a volume of high pressure fluid being moved from a first end to a second end thereof;

(ii) a throat region defining a narrowest diameter region of said bell-like nozzle opening;

(iii) a first expansion region for producing a linear expansion of said volume of high pressure fluid passing through said throat region, said first expansion region has a radius "r1" and a length "s1" running from said throat region towards said second end, and said radius r1 and length s1 are determined such that (dr1/ds1) is a constant; and (iv) a second expansion region for producing a turning expansion as well as a parallel flow of said volume of high pressure fluid coming from said first expansion region, said second expansion region has a radius "r2", and a length "s2" significantly greater than the length s1 of the first expansion region and running from said first expansion region towards said second end, and said radius r2 and length s2 are determined such that (dr2/ds2) is non-linear and is equal to a function of s2.

11. A fluidized bed jet mill for grinding particles of material, the fluidized bed jet mill comprising:

(a) a base, a top and side walls defining a grinding chamber having a central axis; and (b) plural nozzle devices mounted through said side walls into said grinding chamber to discharge a composite stream of high velocity fluid, each said nozzle device having a first end, and a second end pointing towards said central axis of said grinding chamber, and each said nozzle device including at least one nozzle opening for discharging an individual stream of high velocity fluid through said second end for entraining the particles of material, each said at least one nozzle opening having a nozzle axis and nozzle wall sections defining:

(i) a converging region having a first nozzle wall section located towards said first end for converging and accelerating a volume of high pressure fluid being moved from said first end for discharge through said second end;

(ii) a throat region having a second nozzle wall section defining a narrowest diameter of said nozzle opening;

(iii) a first expansion region for producing a linear expansion of said volume of high pressure fluid passing through said throat region, said first expansion region including a third nozzle wall section having a radius "r1" and a length "s1" running from said throat region towards said second end, and said radius r1 and length s1 being such that (dr1/ds1) is a constant; and (iv) a second expansion region for producing a turning expansion and parallel flow of said volume of high pressure fluid from said first expansion region, said second expansion region including a fourth nozzle wall section having a radius "r2", and a length "s2" significantly greater than the length s1 of the first expansion region and running from said first expansion region towards said second end, and said radius r2 and length s2 being such that (dr2/ds2) is equal to a function of s2.

12. The fluidized bed jet mill of claim 11, wherein said volume of high pressure fluid comprises a volume of high pressure air.

13. The fluidized bed jet mill of claim 11, wherein each said nozzle device is cylindrical and includes a longitudinal axis and said plural number of nozzle openings is from three to five.

14. The fluidized bed jet mill of claim 13 wherein each nozzle opening of said plural number of nozzle openings is located a distance DS from said longitudinal axis.

15. The fluidized bed jet mill of claim 13 wherein each nozzle opening of said plural number of nozzle openings has a nozzle axis slanted inwardly such that each said nozzle axis thereof intersects said longitudinal axis of said nozzle device at a point downstream of said second end of said nozzle device.

16. The fluidized bed jet mill of claim 13 wherein adjacent nozzle openings of said plural number of said nozzle openings border a space between them for receiving particles during operation of the nozzle device.

17. The fluidized bed jet mill of claim 15 wherein said composite stream of high velocity fluid has a low velocity region downstream of said second end of said nozzle device and upstream of said point of intersection of said individual streams of high velocity fluid.

18. The fluidized bed jet mill of claim 15 wherein when said nozzle device is mounted through said side walls, each said nozzle axis thereof intersects said longitudinal axis of said nozzle device at a point between said central axis of said grinding chamber and said second end of said nozzle device.

19. The fluidized bed jet mill of claim 16 wherein each said space between adjacent said nozzle openings is located opposite to, and on a common diameter with, one of said plural odd number of said nozzle openings.

20. The fluidized bed jet mill of claim 16 including a plural odd number of said spaces for receiving particles during operation of the nozzle device.

* * * * *